US005256831A

United States Patent [19]

Kozuki et al.

[11] Patent Number: 5,256,831

[45] Date of Patent: Oct. 26, 1993

[54] ENVELOPE WAVEFORM GENERATION APPARATUS

[75] Inventors: Koichi Kozuki; Kazuhisa Okamura; Tetsuji Ichiki, all of Hamamatsu, Japan

[73] Assignee: Yamaha Corporation, Hamamatsu, Japan

[21] Appl. No.: 727,548

[22] Filed: Jul. 9, 1991

[30] Foreign Application Priority Data

Jul. 10, 1990 [JP] Japan ..... 2-180666
Jul. 10, 1990 [JP] Japan ..... 2-180667
Jul. 10, 1990 [JP] Japan ..... 2-180668

[51] Int. Cl.[5] ..... G10H 1/057

[52] U.S. Cl. ..... 84/627; 84/663

[58] Field of Search ..... 84/624, 627, 663, 656

[56] References Cited

U.S. PATENT DOCUMENTS 4,119,006 10/1978 Whitefield ..... 84/663 X
4,373,416 2/1983 Endo et al. ..... 84/604
4,422,363 12/1983 Deforeit ..... 84/663 X
4,426,904 1/1984 Ishibashi ..... 84/663 X
4,662,261 5/1987 Akutsu ..... 340/365.5 X
4,909,120 3/1990 Horiki et al. ..... 84/627
4,928,569 5/1990 Kudo et al. ..... 84/626
5,074,185 12/1991 Nishikawa et al. ..... 84/627
5,094,137 3/1992 Matsumoto ..... 84/615

*Primary Examiner*—William M. Shoop, Jr.
*Assistant Examiner*—Brian Sircus
*Attorney, Agent, or Firm*—Spensley Horn Jubas & Lubitz

[57] ABSTRACT

An envelope waveform generation apparatus comprises an envelope waveform signal generator for forming an envelope waveform signal, a specific position setting member for setting a specific position, a position comparator and a key OFF controller. When a key OFF event is detected, the position comparator compares a position and/or level on the envelope waveform with those of the specific position, and the key OFF controller decays the level of the envelope waveform signal in the shape of a predetermined key OFF waveform, or delays key OFF processing by the envelope waveform signal generator on the basis of the comparison result.

14 Claims, 12 Drawing Sheets

ENVELOPE WAVEFORM GENERATION APPARATUS

BACKGROUND OF THE INVENTION

1. Field of the Invention

The present invention relates to an envelope waveform generation apparatus suitable for an electronic musical instrument.

2. Description of the Prior Art

As a conventional envelope waveform generation apparatus for an electronic musical instrument, an apparatus for generating an envelope waveform consisting of a plurality of states, e.g., an attack state, a decay state, and the like is known (e.g., Japanese Patent Publication No. 63-39072).

However, in a conventional envelope waveform generation apparatus, when a tone is to be sustained or a release time is prolonged upon a key OFF event, if a key OFF event is detected at an instance when the level of an envelope waveform is increased in, e.g., an attack state, the envelope waveform is sustained or released from the increased level, and the high-level envelope waveform is undesirably sustained for a long period of time. If tone volume control of a tone is performed according to this envelope waveform, a performance tone becomes unnatural.

If a key OFF event is detected extremely early, i.e., before an envelope waveform sufficiently rises, the envelope waveform begins to decay before an attack feeling is provided.

Furthermore, decay characteristics of an envelope waveform after a key OFF event are not changed regardless of the way of playing the musical instrument, and performance tones become monotonous.

SUMMARY OF THE INVENTION

The present invention has been made in consideration of the conventional drawbacks, and has as its first object to provide an envelope waveform generation apparatus which can prevent generation of unnatural tones regardless of the presence/absence of a sustain effect, the length of a release time, a key OFF timing, and the like.

It is the second object of the present invention to provide an envelope waveform generation apparatus which can generate an envelope waveform having a sufficient attack feeling when a key OFF timing is extremely early.

It is the third object of the present invention to provide an envelope waveform generation apparatus which can change decay characteristics of an envelope waveform in accordance with a key OFF timing.

In order to achieve the first object, according to the first aspect of the present invention, a specific position is set on an envelope waveform, and the envelope waveform is caused to decay according to a key OFF waveform which is determined based on whether or not a position (key OFF position) of the envelope waveform at a key OFF timing is before the specific position with respect to time, and whether or not the envelope waveform has a high level.

For example, the envelope waveform consists of an attack state in which the amplitude is rapidly increased, a decay state in which the amplitude rapidly decays, a hold state in which the amplitude is constant or an identical envelope waveform is repeated, and a release or sustain state in which the amplitude slowly decays, which states are arranged in the order named. In this case, for example, when the key OFF position is after the specific position, an inclination (rate) for decaying the key OFF waveform corresponds to the rate of the release or sustain state as a normal key OFF rate. When the key OFF position is before the specific position, and the waveform has a high level, the rate is set to be a larger value so as to more rapidly decay the envelope waveform. As the key OFF rate to be set when the key OFF position is before the specific position, and the waveform has a high level, the rate of the decay state can be set.

According to the above-mentioned arrangement, a specific position determined by an elapse time from a key ON event, a level, and the like is set on an envelope waveform, and it is detected whether or not the position (key OFF position) on the envelope waveform upon a key OFF event is before the specific position with respect to time, and whether or not the waveform has a high level. On the basis of the detection result, when the key OFF position is present in, e.g., an attack state, that is, the key OFF position is located at a position where the tone level is relatively large, the envelope waveform is caused to decay more rapidly (see FIG. 8).

Therefore, according to the first aspect of the present invention, a high-level envelope waveform can be prevented from being sustained regardless of the presence/absence of a sustain effect, the length of a release time, a key OFF timing, and the like.

In order to achieve the second object, according to the second aspect of the present invention, a specific position (timing and/or level) is set on an envelope waveform, the position of the envelope waveform at a key OFF timing is compared with the specific position, and key OFF processing of the envelope waveform is delayed on the basis of the comparison result.

For example, when the envelope waveform consists of the states arranged in the above-mentioned order, the specific position is set immediately after the attack state. When the key OFF timing is before the specific position, the key OFF processing of the envelope waveform can be delayed to the specific position.

With the above-mentioned arrangement, even when the key OFF timing is extremely early, i.e., before the envelope waveform sufficiently rises, the key OFF processing of the envelope waveform can be delayed until the envelope waveform sufficiently rises (see FIG. 10).

Therefore, according to the second aspect, even when the key OFF timing is too early, an envelope waveform having a sufficient attack feeling can be generated.

In order to achieve the third object, according to the third aspect of the present invention, a specific position is set on an envelope waveform, and it is detected whether or not a key OFF event occurs before the specific position. Key OFF (decay) processing of the envelope waveform is performed based on characteristics according to the position where the key OFF event occurs.

The third aspect will be described in detail below. For example, when the envelope waveform consists of the states arranged in the above-mentioned order, a decay point as the specific position is set on the envelope waveform. When a key OFF event occurs before the decay point, the envelope is caused to decay according to first decay characteristics (e.g., a release or sustain rate). On the other hand, when a key OFF event occurs after the decay point, the envelope is caused to decay according to second decay characteristics different from the first decay characteristics. Therefore, the decay characteristics can be changed when a playing method is changed (see FIGS. 9 and 12). For example, when the decay rate of the first decay characteristics is set to be larger than that of the second decay characteristics, an envelope can be caused to immediately decay when near-staccato tones are generated; otherwise, a reverberation feeling can be provided. Thus, an instrument can be played in different styles. For this reason, according to an electronic musical instrument using this apparatus, a player can make a performance according to his or her favor.

When the first or second characteristics are set so that the level of an envelope is temporarily increased upon a key OFF event, and then is caused to decay, a click feeling can be provided to a tone upon a key OFF event. However, this is not important in this aspect.

According to the third aspect, decay characteristics of an envelope waveform can be selected according to a key OFF timing.

Therefore, in an electronic musical instrument to which this aspect is applied, a release time upon a key OFF event can be desirably changed according to a performance operation state.

DETAILED DESCRIPTION OF THE PREFERRED EMBODIMENT

An embodiment of the present invention will be described hereinafter with reference to the accompanying drawings.

Figure 1:
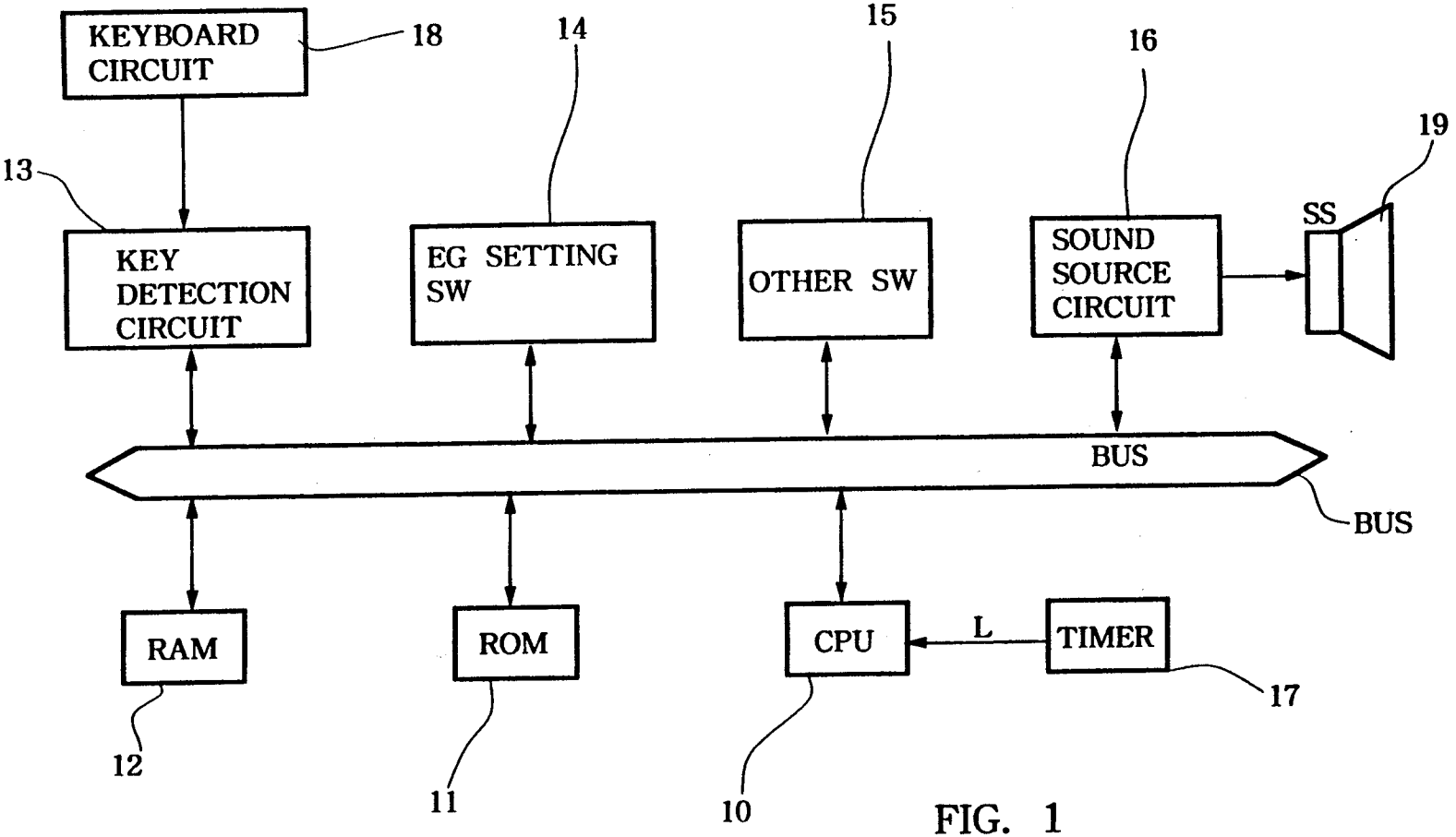
FIG. 1 is a block diagram showing a hardware arrangement of an electronic musical instrument according to an embodiment of the present invention.

FIG. 1 shows a hardware arrangement of an electronic musical instrument according to an embodiment of the present invention.

A central processing unit (CPU) 10 of the electronic musical instrument shown in FIG. 1 controls operations of the overall instrument. The CPU 10 is connected to a read-only memory (ROM) 11, a random-access memory (RAM) 12, a key detection circuit 13, an EG setting switch group 14, another switch group 15, and a sound source circuit 16 via a bidirectional bus line BUS. The CPU 10 is also connected to a timer circuit 17 via a signal line L. The key detection circuit 13 is connected to a keyboard circuit 18, and the sound source circuit 16 is connected to a sound system 19.

A program area and a parameter area are allocated on the ROM 11. Various control programs for main routine processing, timer interrupt processing, and the like corresponding to the flow charts shown in FIGS. 2 to 7 are stored in the program area. An envelope waveform of a tone generated by this electronic musical instrument has an attack state, a decay state, a hold state, and a release or sustain state, as shown in FIGS. 8 to 11. The parameter area stores rate data representing inclinations of the respective states (excluding the hold state) of the envelope waveform, and level data representing a target (final) level as tables in units of tone colors.

The following registers are allocated on the RAM 12. These registers temporarily store various data generated when the CPU 10 executes the control program. Note that the registers and their contents are represented by the same labels in the following description. In addition, i (=0 to 7) indicates a state number. For example, state 0 represents an attack state, and state 1 represents a decay state. Furthermore, j (=0 to 15) indicates a tone generation channel number.

Li: Target Level of State i 0 to 95.25 (0.75 step, 7 bits)
Ri: Rate of State i 0 to 95.25 (0.75 step, 7 bits)
RR: Release Rate 0 to 95.25 (0.75 step, 7 bits)
SUSR: Sustain Rate 0 to 95.25 (0.75 step, 7 bits)
EGj: Present Envelope Level of Channel j 0 to 95.25 (0.75 step, 7 bits)
INTj: Initial Touch of Channel j 0 to 127 (7 bits)
KCDj: Key Code Assigned to Channel j for Tone Generation
MP: Mask Point, 0 to 7 (3 bits)
DP: Decay Point, 0 to 7 (3 bits)
HP: Hold Point, 0 to 7 (3 bits)
SUSON: Sustain flag 1: Sustain ON 2: Sustain OFF
SYNM: Synthesis Flag 1: Synthesis Mode 0: Normal Mode
DPINH: DP Inhibit Flag 1: DP Inhibit 2: DP Enable
HOLDj: Hold Flag of Channel j 1: Hold
KONj: Key ON Flag of Channel j 1: Key ON
KOFFj: Key OFF Flag of Channel j
1: End of Formation of Envelope Waveform The key detection circuit 13 detects operation states of keys on the keyboard circuit 18, and generates key data representing a key ON event, a key OFF event, and a key touch (initial touch) in units of keys.

The EG setting switch group 14 includes a sustain ON/OFF switch, a synthesis mode setting switch, a DP inhibit switch, and the like, and generates switch data representing an ON/OFF or setup state in units of these switches.

Other switches 15 include a tone color selection switch, a tone volume setting switch, and various effect switches.

The sound source circuit 16 forms a tone signal on the basis of the ON/OFF or setup states of the EG setting switch group 14 and the other switch group 15, envelope data EGj sent from the CPU 10 upon operation of the keyboard circuit 18, and musical tone control data such as a note ON/OFF command, key code data KCDj, initial touch data INTj, and the like. The tone signal is supplied to the sound system 19. The sound source circuit 16 has 16 time-divisional tone generation channels represented by the number j (=0 to 15), and the electronic musical instrument of this embodiment can simultaneously generate 16 tones.

The sound system 19 converts the tone signal supplied from the sound source circuit 16 into an acoustic wave, and produces it as an actual sound.

The operations of the CPU 10 in the electronic musical instrument shown in FIG. 1 will be described below with reference to the flow charts of FIGS. 2 to 7.

When a power switch (not shown) of the electronic musical instrument shown in FIG. 1 is turned on, the CPU 10 starts its operation in accordance with the control program stored in the ROM 11. First, the CPU 10 executes processing shown in FIG. 2 as a main routine starting from step 201, and also executes timer interrupt processing shown in FIGS. 5A and 5B.

Figure 2:
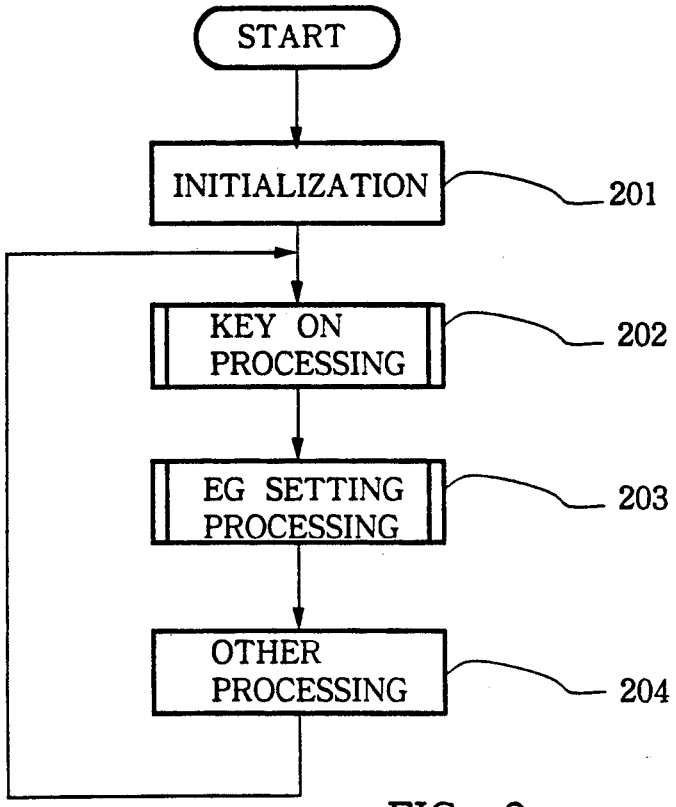
FIGS. 2 to 4, 5A, 5B, 6 and 7 are flow charts showing processing operations executed by a CPU shown in FIG. 1.

Referring to FIG. 2, in step 201, the CPU 10 executes initialization. For example, the CPU 10 clears the target level registers L0 to L7 and the rate registers R0 to R7 in units of states; the release rate register RR; the sustain rate register SUSR; the envelope level registers EG0 to EG15, the initial touch registers INT0 to INT15, the key code registers KCD0 to KCD15, the key ON flags KON0 to KON15, and the hold flags HOLD0 to HOLD15 in units of tone generation channels; the mask point register MP; the decay point register DP; the hold point register HP; the sustain flag SUSON; the synthesis flag SYNM; and the DP inhibit flag DPINH, which registers and flags are allocated in the RAM 12. The CPU 10 also sets the key OFF flags KOFF0 to KOFF15 of the tone generation channels to be 1. Thereafter, the CPU 10 executes loop processing consisting of key ON processing in step 202, EG setting processing in step 203, and other processing in step 204.

Figure 3:
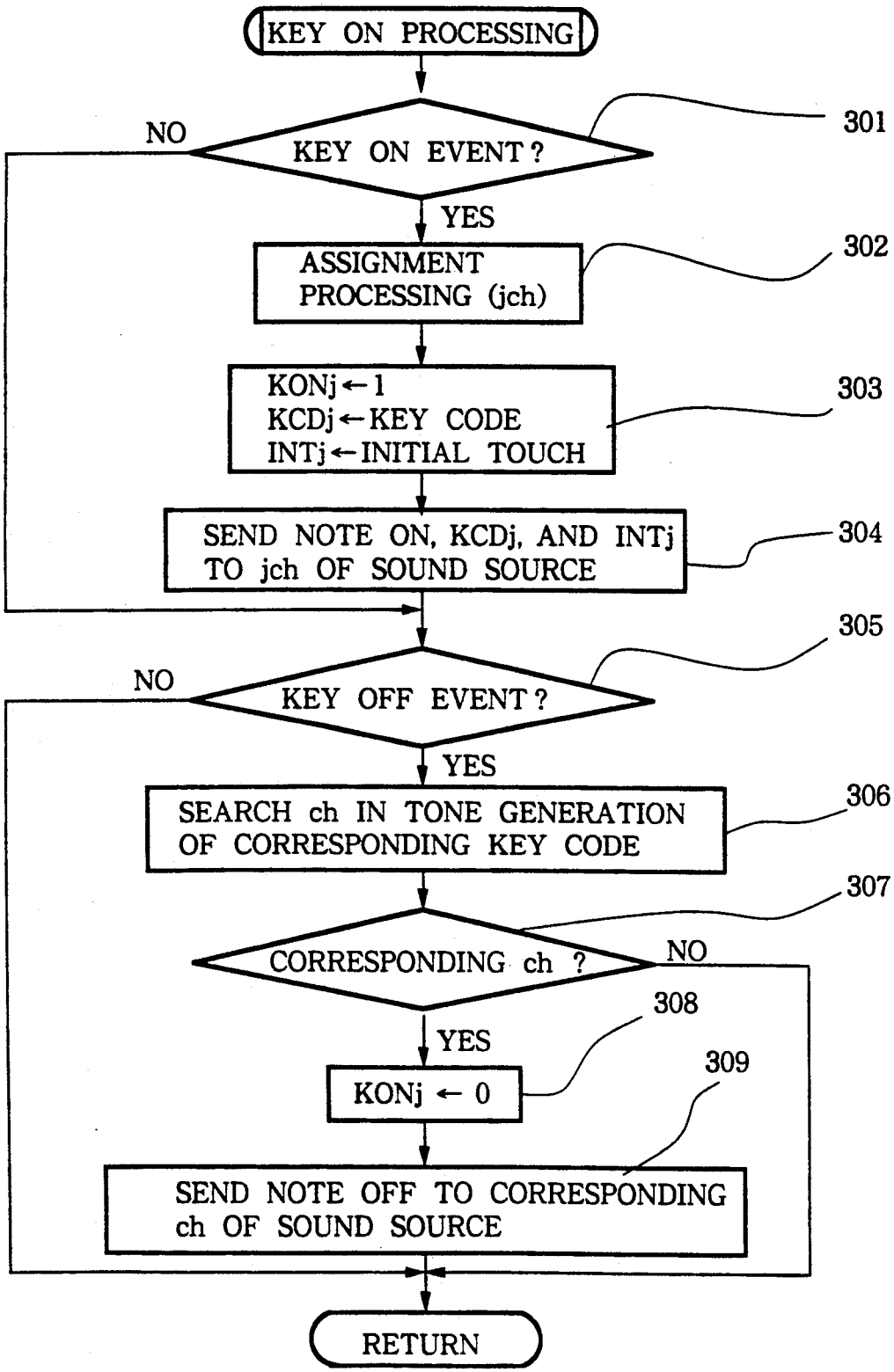

FIG. 3 shows in detail the key ON processing (step 202) shown in FIG. 2.

Referring to FIG. 3, in step 301, it is checked on the basis of an output from the key detection circuit 13 if a key state is changed upon an ON event on the keyboard circuit 18 (presence of key ON event). If YES in step 301, a tone (key code) corresponding to the key where the ON event occurs is assigned to a tone generation channel in step 302. In step 303, the key ON flag KONj of the assigned tone generation channel j is set to be 1, and the key code and initial touch data of the key are respectively stored in the key code register KCDj and the initial touch register INTj. In step 304, a note ON (tone generation start) command, the key code KCDj, and the initial touch data INTj are sent to the channel j of the sound source circuit 16. Thereafter, the flow advances to step 305. Thus, the sound source circuit 16 starts tone forming processing on the basis of the key code data KCDj, the initial touch data INTj, and envelope level data EGj (to be described later).

If NO in step 301, i.e., if it is determined that no key ON event occurs, the flow skips the processing in steps 302 to 304, and directly jumps from step 301 to step 305.

In step 305, the presence/absence of a key OFF operation (key OFF event) on the keyboard circuit 18 is determined on the basis of the output from the key detection circuit 13. If YES in step 305, a tone generation channel to which a key code corresponding to key where the key OFF event occurs is assigned is searched in step 306. If a corresponding channel j is detected, the flow branches from step 307 to step 308, and the key ON flag KONj of the corresponding channel j is reset. In step 309, a note OFF (tone generation stop) command is sent to the corresponding channel j of the sound source circuit 16. Thereafter, the key ON processing is ended, and the flow returns to the main processing (step 203 in FIG. 2). Thus, the sound source circuit 16 performs tone signal forming processing after the key OFF event in the corresponding channel j.

On the other hand, if NO in step 307, i.e., if it is determined that no tone generation channel to which the same key code as the OFF key is assigned is found, the flow skips the processing in steps 308 and 309, and the key ON processing is directly ended from step 307. The flow then returns to the main processing (step 203 in FIG. 2).

If NO in step 305, i.e., if no key OFF event occurs, the flow skips the processing in steps 306 to 309, and the key ON processing is directly ended from step 305. The flow then returns to the main processing (step 203 in FIG. 2).

Figure 4:
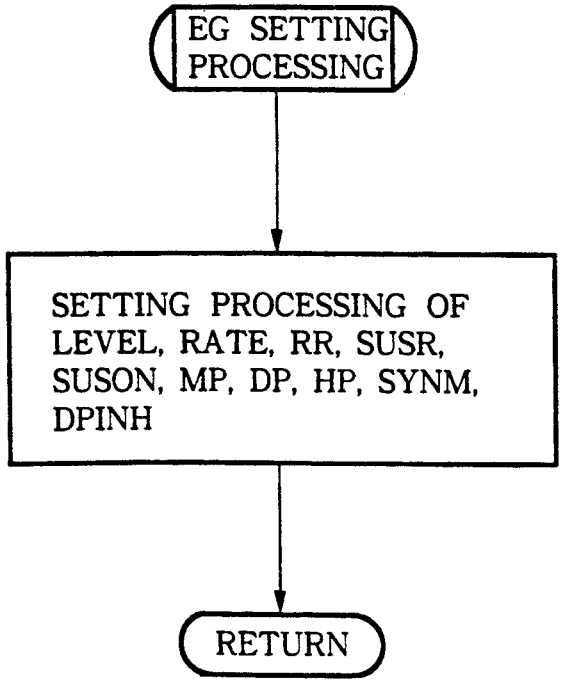

FIG. 4 shows in detail the EG setting processing (step 203) in FIG. 2.

In the EG setting processing, the CPU 10 reads the setup states of the switches constituting the EG setting switch group 14, and stores parameters corresponding to the setup states in the corresponding registers in the RAM 12. For example, for the target levels L0 to L7 of the respective states, the level change rates R0 to R7 of the respective states, the release rate RR, and the sustain rate SUSR, data loaded from a table in the ROM 11 in correspondence with a tone color selected by the tone color selection switch are respectively stored in the corresponding registers L0 to L7, R0 to R7, RR, and SUSR. The mask point parameter MP, the decay point parameter DP, the hold point parameter HP, the sustain ON/OFF parameter SUSON, the synthesis mode ON/OFF parameter SYNM, and the DP inhibit ON/OFF parameter DPINH are generated on the basis of the states of the corresponding switches in the EG setting switch group 14, and are stored in the corresponding registers MP, DP, and HP, and the corresponding flags SUSON, SYNM, and DPINH.

When the CPU 10 receives a pulse clock having a fixed period (e.g., 50 μs) from the timer circuit 17 via the signal line L, it executes timer interrupt processing shown in FIGS. 5A to 7 using the clock as an interrupt signal. In this case, envelope waveform forming processing for one tone generation channel represented by a channel number j is executed by the single timer interrupt processing.

Figure 5A:
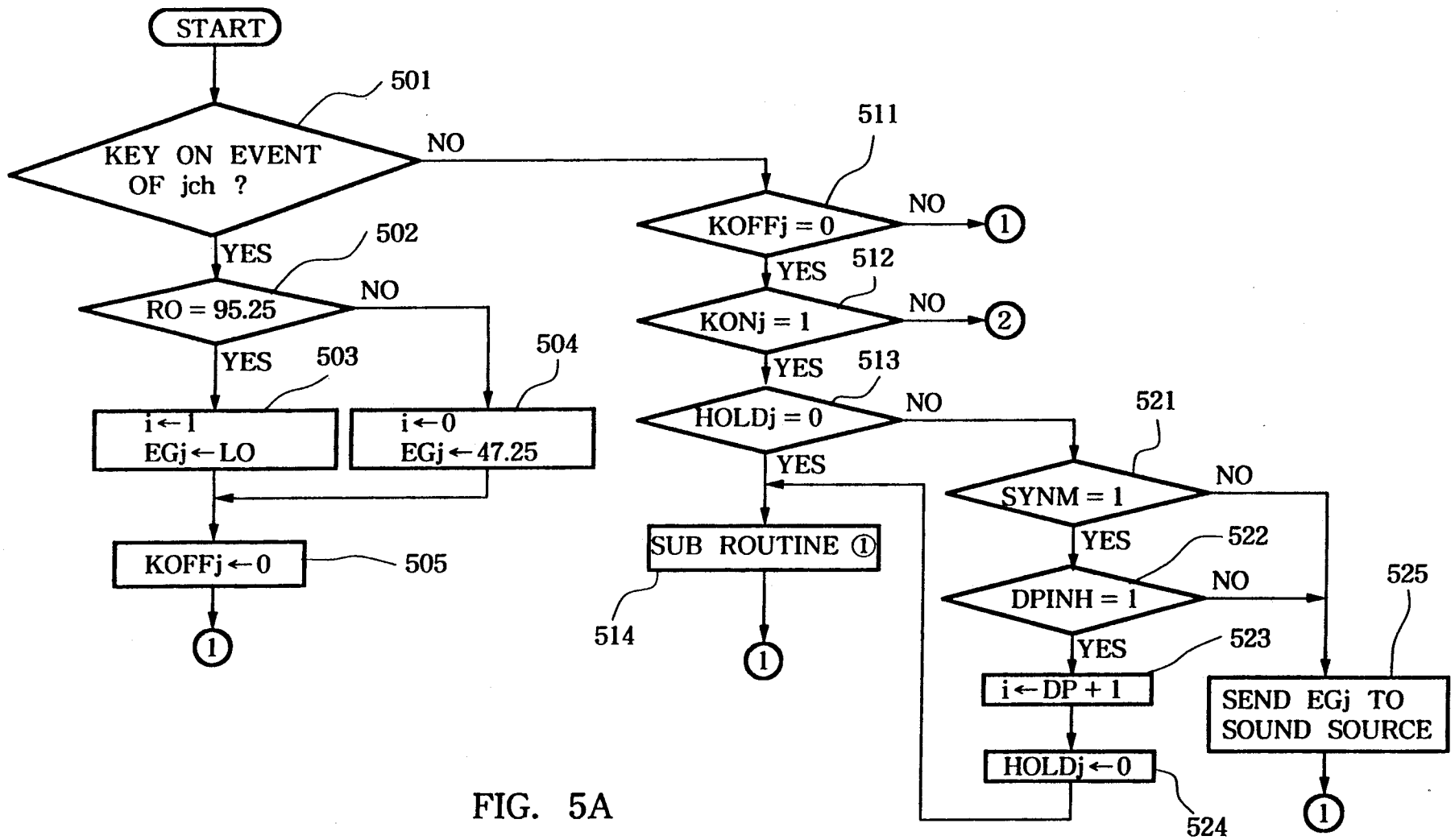
Figure 5B:
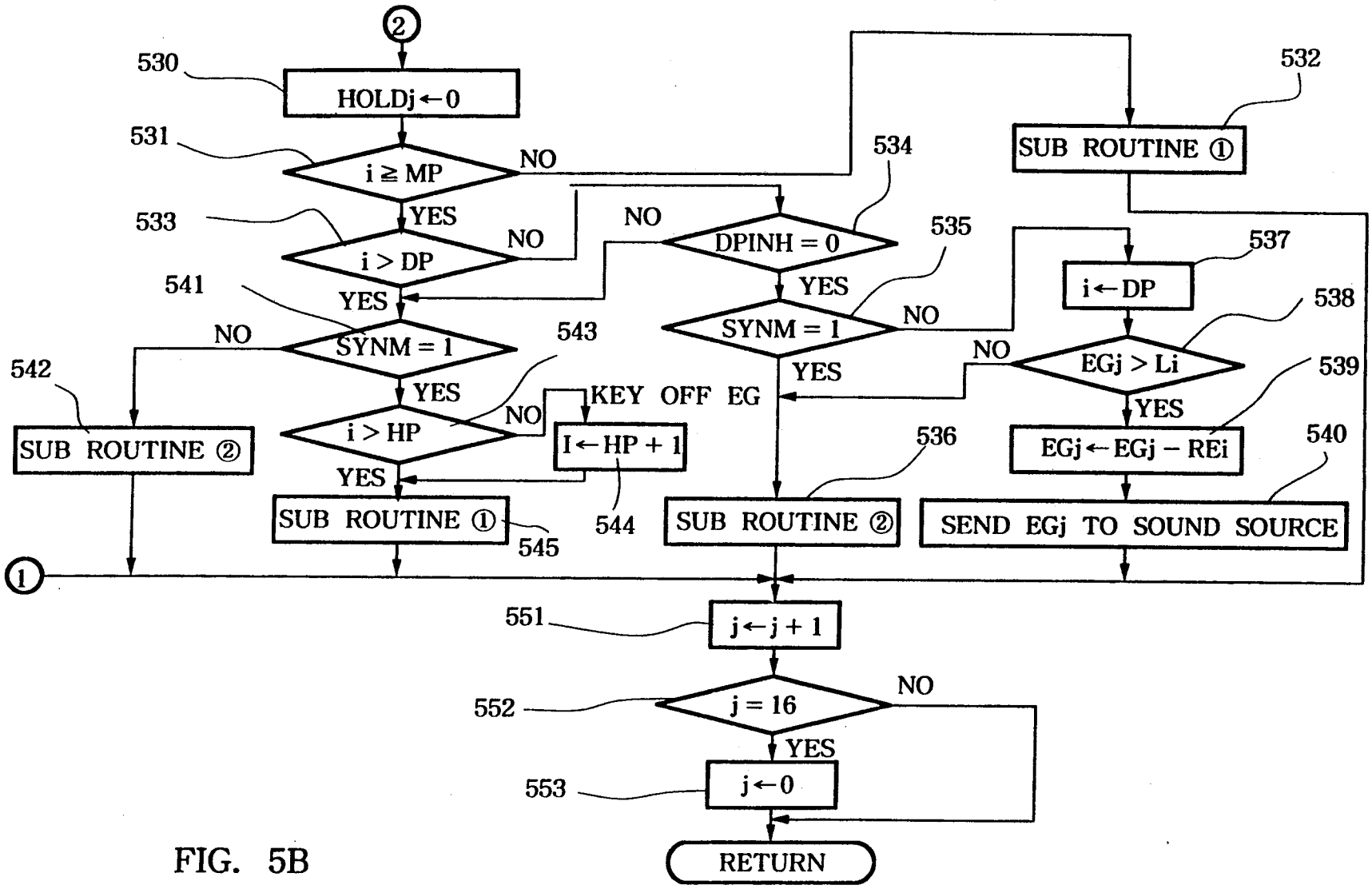

Referring to FIG. 5A, in step 501, it is checked if the timer interrupt processing is the first interrupt processing for a channel j after the channel j is assigned as a tone generation channel. If YES in step 501, it is checked in step 502 if the attack rate R0 has a maximum value (95.25). If YES in step 502, the state number i is set to be 1 and the envelope level EGj is set to be the target level L0 of the attack state (i=0) in step 503. Thereafter, the flow advances to step 505. In this case, the envelope waveform has an extremely steep attack waveform. That is, the initial value is set to be the attack target level L0, and the attack state is instantaneously ended. If it is determined in step 502 that the attack rate R0 does not have a maximum value, the state number i is set to be 0 in step 504, so that the envelope level EGj is set to have a value (47.25) half the maximum value. Thereafter, the flow advances to step 505. In this case, the envelope waveform has an initial value of 47.25, and the attack state starts from this value. In step 505, the key OFF flag KOFFj is reset, and the flow advances to step 551 (FIG. 5B).

If NO in step 501, i.e., if it is determined that the interrupt processing is the second or subsequent processing for the channel j after tone generation assignment to the channel j upon a key ON event, the flow advances to step 511.

In step 511, the key OFF flag KOFFj is checked. The flag KOFFj is set to be 1 when the formation of the envelope waveform signal is completed (step 615 in FIG. 6 and step 707 in FIG. 7). Therefore, in this case, the flow directly advances from step 511 to step 551 (FIG. 5B) without executing processing associated with an envelope any more.

Figure 6:
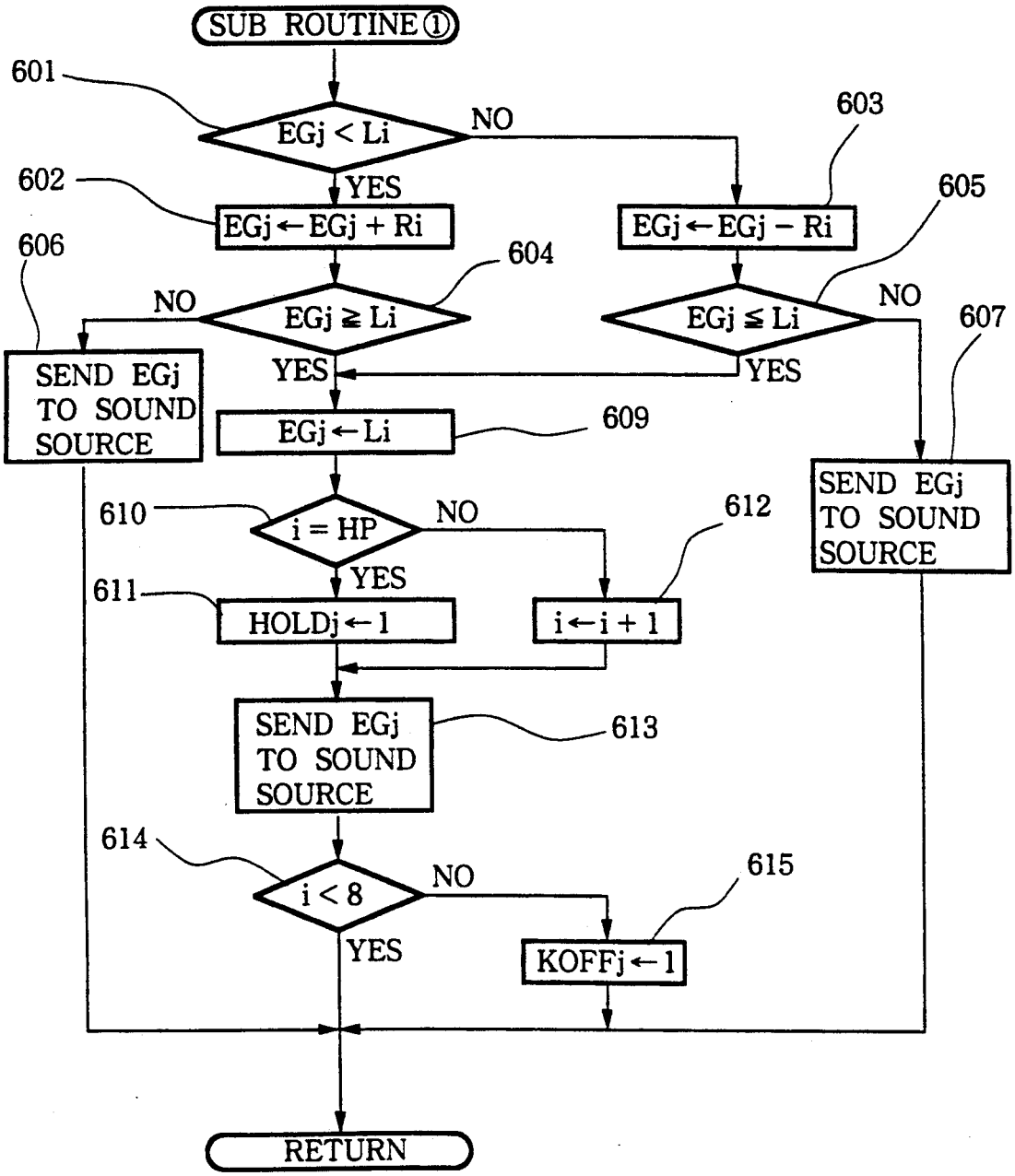

If it is determined in step 511 that KOFFj=0, the key ON flag KONj is checked in step 512. If YES in step 512 (KONj=1), the hold flag HOLDj is checked in step 513. If YES in step 513 (flag HOLDj=0), a subroutine ① (to be described later; FIG. 6) is executed in step 514 to increase/decrease the envelope level EGj by the rate Ri of the present state i. Thereafter, the flow advances to step 551 (FIG. 5B) described above.

If it is determined in step 513 that HOLDj=1, the synthesis mode flag SYNM is checked in step 521. If it is determined in step 521 that the synthesis mode is set (SYNM=1), the DP inhibit flag DPINH is checked in step 522. If it is determined in step 522 that the DP inhibit mode is set (DPINH=1), the state number i is caused to jump to a state DP+1 next to the state set with the decay point DP (state jump) in step 523. In step 524, the hold flag HOLDj is reset, and in step 514, the envelope level increase/decrease processing in the subroutine ① (FIG. 6) is executed. Thereafter, the flow advances to step 551 (FIG. 5B). When the flow advances through the processing in steps 521 to 524, if DP<HP, a waveform from the state number DP+1 to HP is repeated as an envelope waveform by the step jump processing in step 523.

If it is determined in step 521 that the normal mode is set (SYNM=0), and if it is determined in step 522 that the DP enable mode is set (DPINH=0), the flow advances from step 521 or 522 to step 525, and the envelope level data EGj is sent to the sound source circuit 16. Thereafter, the flow advances to step 551 (FIG. 5B).

Referring to FIG. 6, in step 601, the envelope level EGj and the target level Li of the present state i are compared with each other to determine if the present inclination of the envelope waveform is positive or negative. If the inclination is positive (EGj<Li), the rate Ri is added to the level EGj in step 602; if it is negative (EGj≧Li), the rate Ri is subtracted from the level EGj in step 603. Thereafter, it is checked in step 604 or 605 if the envelope level EGj has reached the target level Li. If NO in step 604 or 605, the envelope level data EGj is sent to the sound source circuit 16 in step 606 or 607, and the flow returns to the previous routine (step 551 in FIG. 5B).

On the other hand, if it is determined in step 604 or 605 that the envelope level EGj has reached the target level Li, the flow advances to step 609, and the envelope level EGj is set to be the target level Li. In step 610, it is then checked if the present state i is a state set with the hold point HP. If YES in step 610 (i=HP), the hold flag HOLDj is set in step 611; otherwise, the state number i is incremented in step 612. Thereafter, the envelope level data EGj is sent to the sound source circuit 16 in step 613, and it is checked in step 614 if the state number i has reached 8. In this electronic musical instrument, the number of states of the envelope is set to be 8 (0 to 7). Therefore, if the state number i has reached 8, this means that the envelope waveform forming processing is ended. In this case, the key OFF flag KOFFj is set in step 615, and the flow returns to the previous routine (step 551 in FIG. 5B). However, if it is determined in step 614 that the state number i has not reached 8 yet, the flow directly returns from step 614 to the previous routine (step 551 in FIG. 5B).

Referring back to FIG. 5A, if it is determined in step 512 that the key ON flag KONj=0, this means that a key assigned to the corresponding channel j on the keyboard circuit 18 is subjected to a key OFF operation (see step 308 in FIG. 3). In this case, post-key OFF processing shown in FIG. 5B is executed.

Referring to FIG. 5B, in step 530, the hold flag HOLDj is cleared, and in step 531, it is checked if the present state i corresponds to a state after the state set with the mask point MP (i≧MP). The mask point MP is set so as not to immediately accept a key OFF event occurring before the point MP, and to form a key OFF envelope after the envelope waveform is formed up to the mask point MP. Therefore, if the present state i corresponds to a state before the state MP set with the mask point MP (i<MP), the envelope level increase/decrease processing in the subroutine ① (FIG. 6) is executed in step 532, and the flow then advances to step 551. In this case, the same envelope waveform forming processing as that in the key ON operation is continued.

Figure 7:
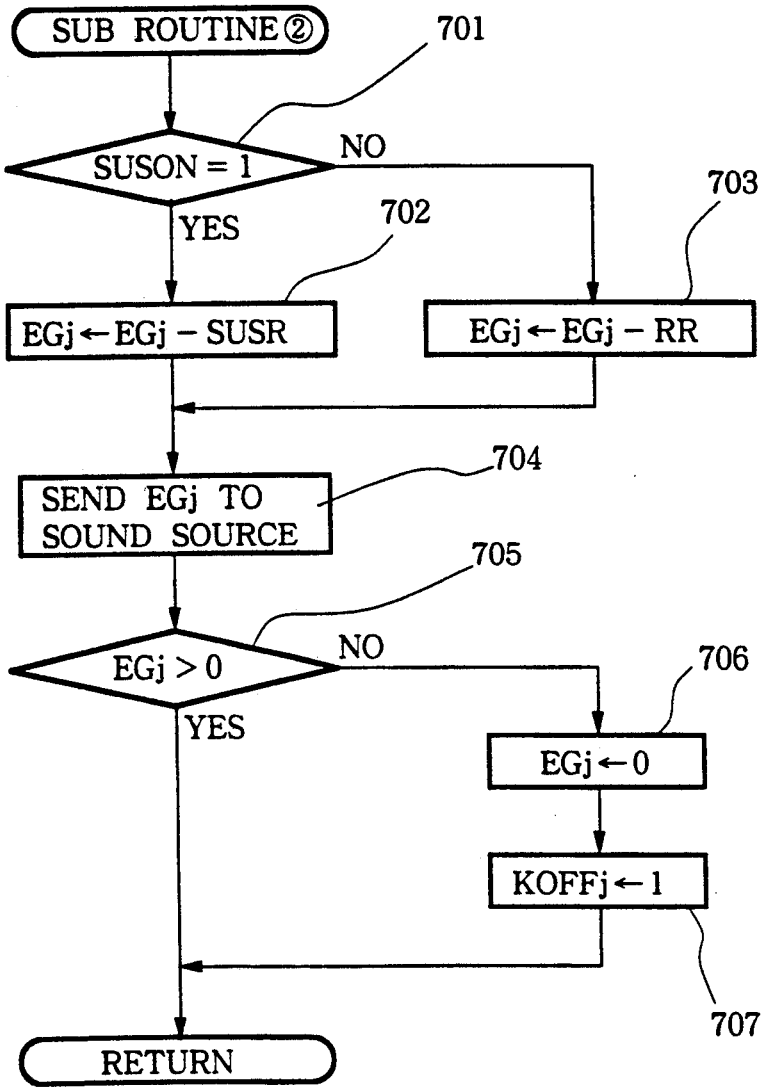

If YES in step 531, i.e., if it is determined that the present state i corresponds to a state after the state set with the mask point MP (i≧MP), it is checked in step 533 if the present state i corresponds to a state after the state set with the decay point DP (i>DP). The decay point DP is set to form different envelope waveforms after a key OFF event depending on whether the key OFF event occurs before or after the decay point DP. If the present state i corresponds to a state before the state set with the decay point DP (i≦DP), the DP inhibit flag DPINH is checked in step 534. The DP inhibit mode (DPINH=1) means that the decay point DP is ignored. Therefore, if the DP inhibit flag DPINH=1, a standard key OFF envelope waveform set according to the synthesis mode and the normal mode is formed in step 541 and subsequent steps. On the other hand, if the DP inhibit flag DPINH=0, a key OFF envelope waveform corresponding to the key OFF event before the decay point DP and different from the standard key OFF envelope is formed. More specifically, the synthesis flag SYNM is checked in step 535. If it is determined in step 535 that the synthesis mode is set (SYNM=1), release/sustain processing in a subroutine ② (to be described later; FIG. 7) is executed in step 536, and the flow then advances to step 551.

Referring to FIG. 7, in step 701, the sustain flag SUSON is checked. If it is determined in step 701 that the sustain ON mode is set (SUSON=1), the envelope level EGj is caused to decay by the sustain rate SUSR; otherwise, i.e., if it is determined that the sustain OFF mode is set (SUSON=0), the envelope level EGj is caused to decay by the release rate RR. Thereafter, the envelope level data EGj is sent to the sound source circuit 16 in step 704. It is then checked in step 705 if the envelope level EGj is larger than 0. If it is determined in step 705 that the envelope level EGj is equal to or smaller than 0 (EGj≦0), the level EGj is set to be 0 in step 706, and the key OFF flag KOFFj is set to be 1 in step 707; otherwise, i.e., if it is determined in step 705 that the envelope level EGj is larger than 0 (EGj>0), the flow returns to the previous routine (step 551 in FIG. 5B). When the level EGj is set to be 0 in step 706, and the key OFF flag is set to be KOFFj=1 in step 707, the timer interrupt processing in FIG. 5A is executed for the corresponding channel without going through the envelope level EGj increase/decrease processing (the subroutines ① and ②, and step 538 to be described later) in a path from step 511 to step 525. For this reason, the envelope level EGj is kept constant to be 0. More specifically, the envelope waveform forming processing for the corresponding channel is ended.

Referring back to FIG. 5B, if it is determined in step 535 that the normal mode is set (SYNM=0), the state number i is set to be DP (state jump) in step 537. Thereafter, it is checked in step 538 if the envelope level EGj has reached the target level Li of the state DP (i=DP).

If it is determined in step 538 that the level EGj has not reached the target level Li yet (EGj≧Li), the release/-sustain processing in the subroutine ② shown in FIG. 7 is executed in step 536, and the flow then advances to step 551. However, if it is determined in step 538 that the level EGj has reached the target level Li (EGj>Li), envelope decay processing using the decay rate Ri (i=DP) as the rate of the state DP is performed in step 539, and the envelope level data EGj is sent to the sound source circuit 16 in step 540. Thereafter, the flow advances to step 551.

On the other hand, if it is determined in step 533 that the present state i corresponds to a state after the decay point DP (i>DP), the standard key OFF envelope waveform forming processing in step 541 and subsequent steps is executed. More specifically, in step 541, the synthesis mode flag SYNM is checked. If it is determined in step 541 that the normal mode is set (SYNM=0), the release/sustain processing in the subroutine ② (FIG. 7) is executed in step 542, and the flow then advances to step 551. Therefore, when a key OFF event occurs after the decay point DP (i>DP) in the normal mode (SYNM=0), the key OFF envelope becomes a release or sustain waveform formed by the processing in the subroutine ② (FIG. 7). More specifically, the standard key OFF envelope waveform in the normal mode (SYNM=0) is the release or sustain waveform.

On the other hand, if it is determined in step 541 that the synthesis mode (SYNM=1) is set, it is checked in step 543 if the present state number i is after the hold point HP. If it is determined in step 543 that the number i is before the hold point HP (i≦HP), the state number i is set to be HP+1 as a state number immediately after the hold point (state jump) in step 544; otherwise, i.e., if it is determined that the number i is after the hold point HP (i>HP), the flow advances to step 545. In step 545, the envelope level increase/decrease processing in the subroutine ① (FIG. 6) is executed, and the flow then advances to step 551.

In steps 551 to 553, the tone generation channel is switched to the next channel. More specifically, the channel number j is incremented in step 551, and thereafter, it is checked in step 552 if the channel number j has reached 16. In this electronic musical instrument, the number of tone generation channels is 16 (number j=0 to 15). Therefore, if the number j is not 16, the control escapes the timer interrupt routine, and returns to the main routine. On the other hand, if the channel number j has reached 16, the channel number is set to be j=0 next to j=15 in step 553. Thereafter, the control escapes the timer interrupt routine, and returns to the main routine.

With the above-mentioned operations, envelope waveforms shown in FIGS. 8 to 12 can be formed.

FIGS. 8 to 12 are envelope waveform charts when the hold point HP is set to be 3. Each of FIGS. 8 to 11 corresponds to a case wherein the attack rate R0 is set to be a value smaller than the maximum value (95.25).

Forming processing of such an envelope waveform is started when a key ON event is detected (step 301 in FIG. 3), tone generation channel assignment is performed (step 302), and the key ON flag KONj is set (step 303). Decay muting processing of the waveform is performed when a key OFF event is detected (step 305), and the key ON flag KONj is reset (step 308).

In the timer interrupt processing (FIG. 5A) of the corresponding tone generation channel immediately after a key ON event is detected, the initial values of the envelope level EGj and the state number i are respectively set to be 47.25 and 0 (attack state) in step 504 described above. Thus, the envelope waveform starts from the initial position designated by these initial values.

Figure 8:
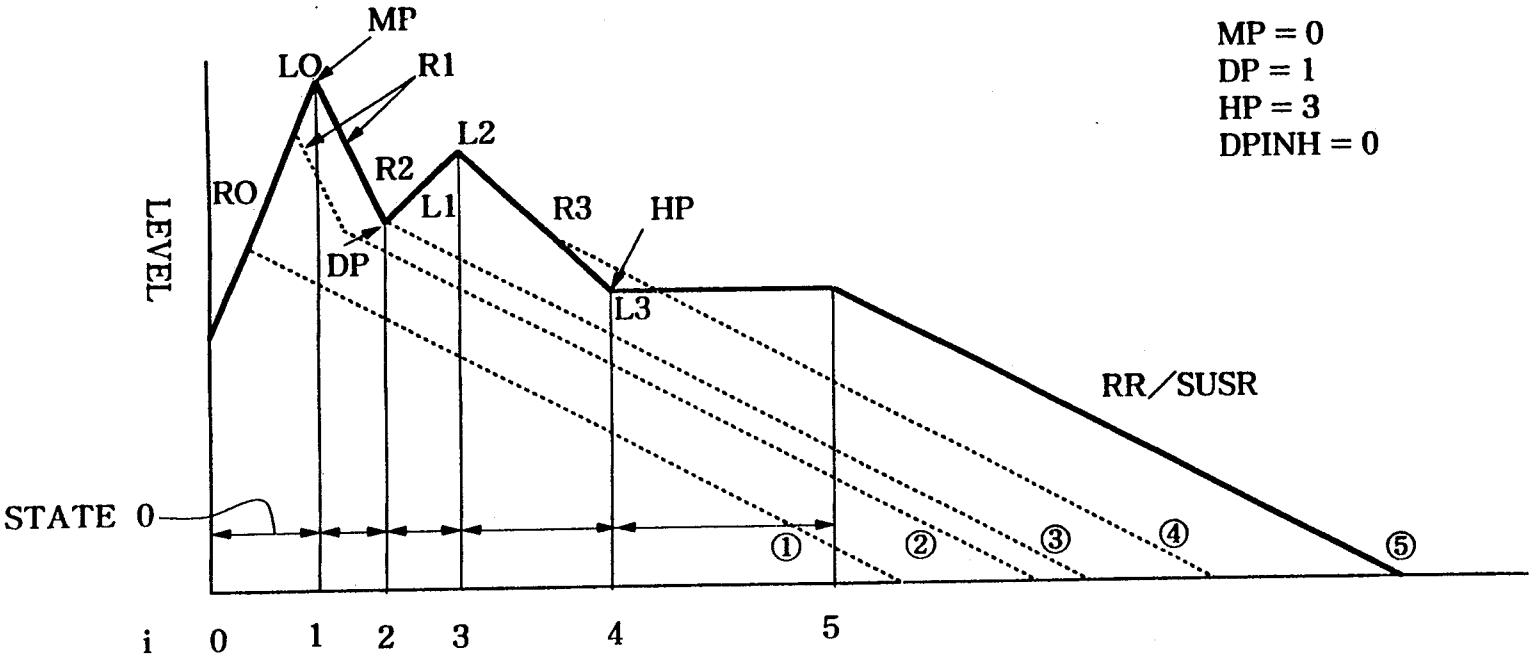
FIGS. 8 to 12 are envelope waveform charts of envelope waveforms formed by a sound source circuit shown in FIG. 1.
Figure 9:
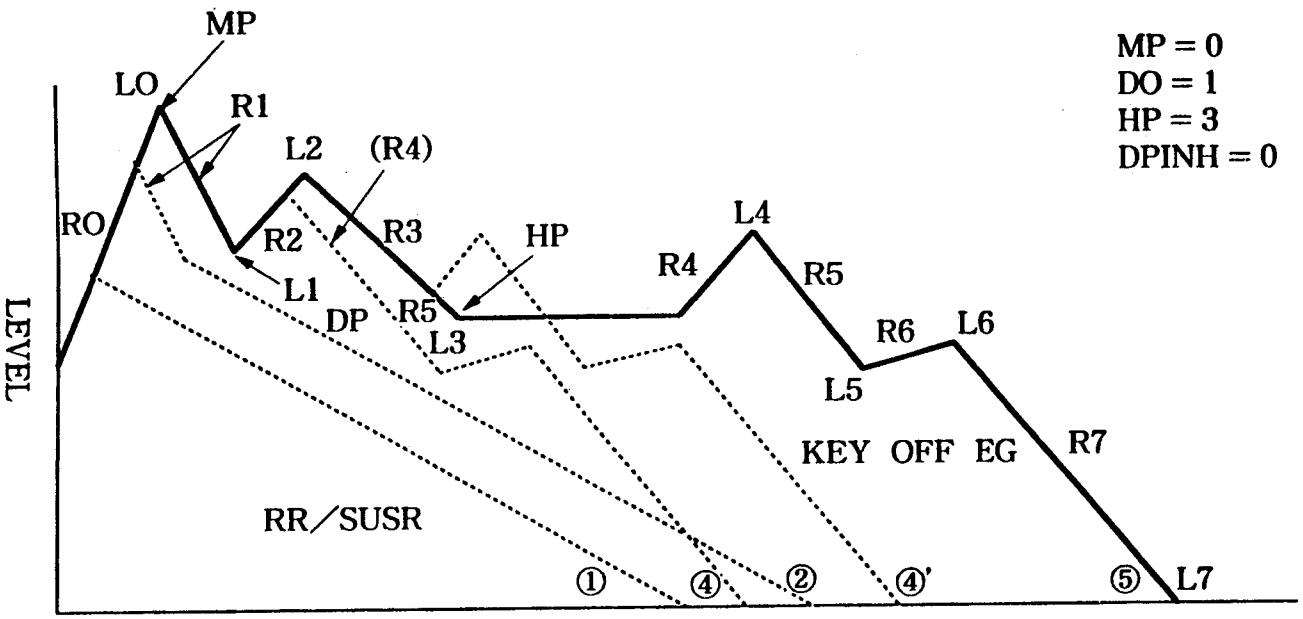
Figure 10:
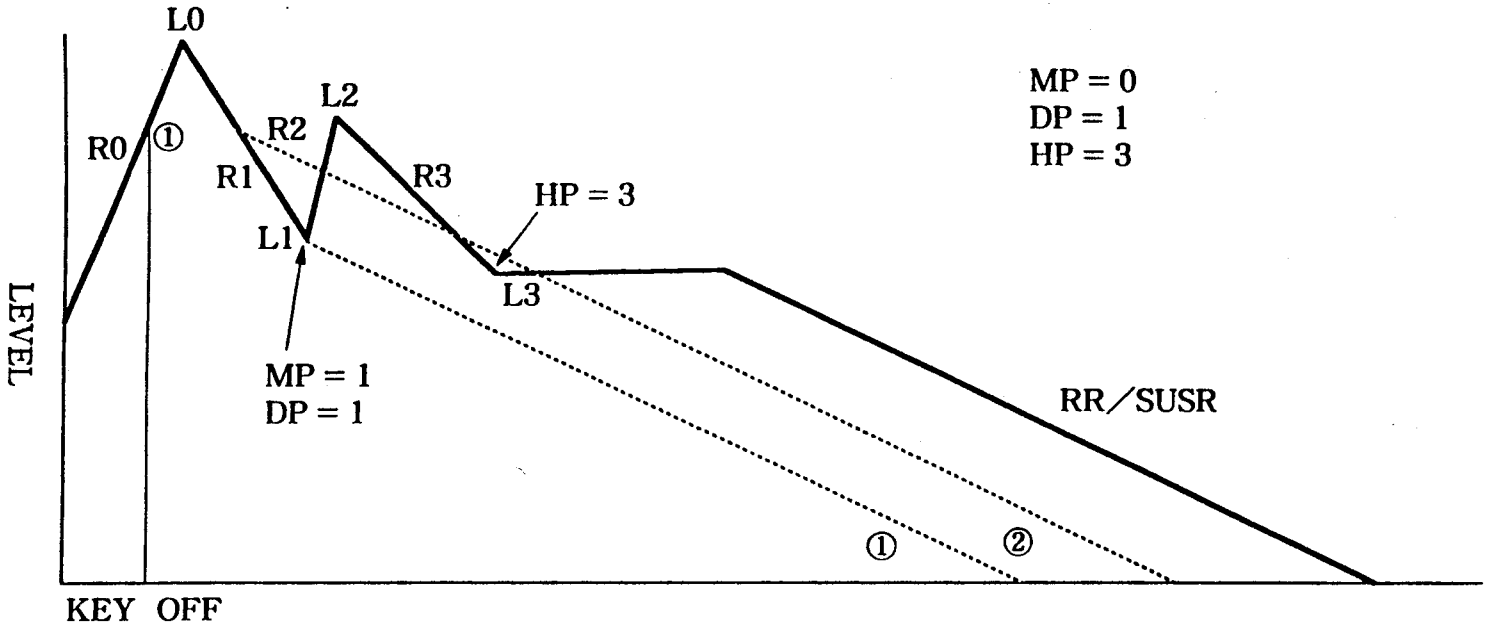
Figure 11:
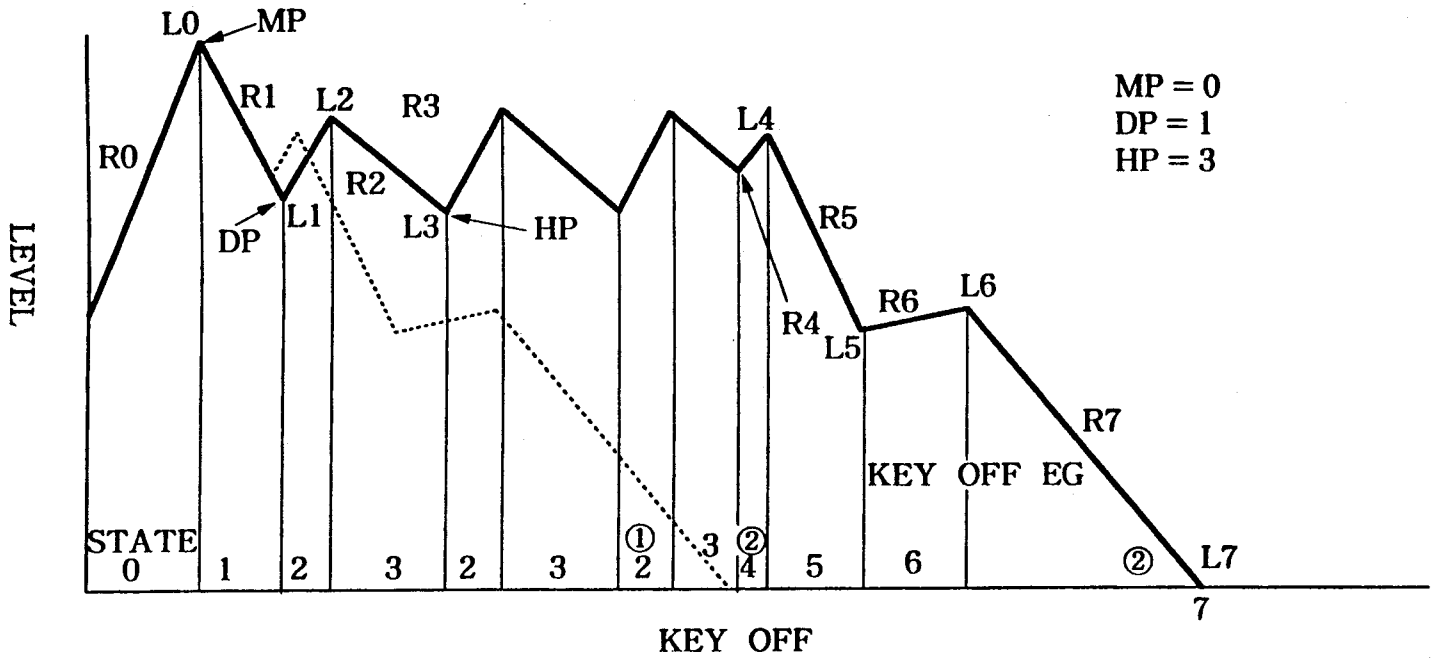
Figure 12:
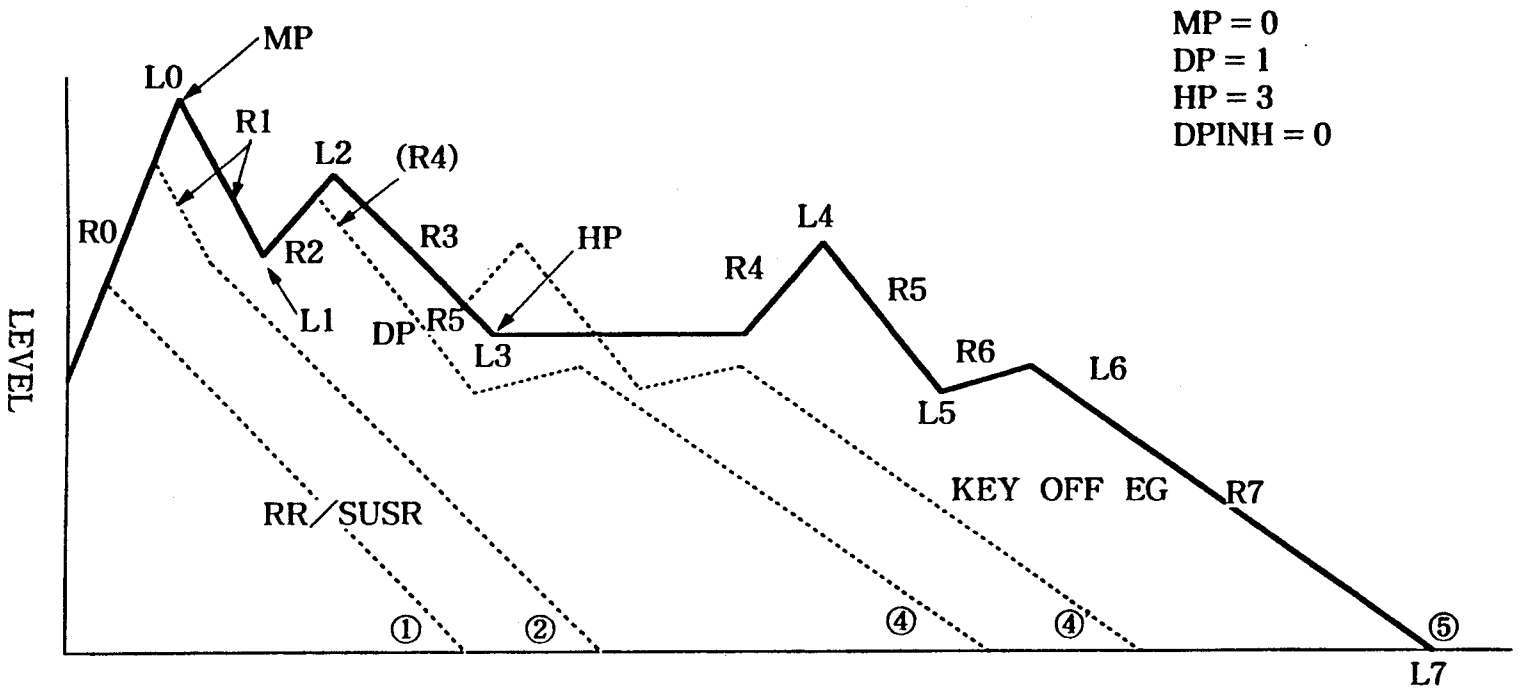

In the envelope waveforms shown in FIGS. 8 to 12, inclination portions excluding the release or sustain state RR/SUSR are formed upon execution of the processing in step 602 or 603 (FIG. 6) in each timer interrupt processing. With the processing in step 612, the inclinations of the envelope waveforms shown in FIGS. 8 to 12 are switched (state switching), and when the control skips steps 610 to 612, flat portions (hold states) shown in FIGS. 8 10 and 12 are formed. Furthermore, when the hold flag HOLDj is set in step 611, state jump in step 523 is executed, and repetition of the state numbers 2 and 3 in FIG. 11 is realized.

Envelope forming processing in a key OFF mode will be described below. In the following description, item numbers with circles coincide with reference numerals of broken lines indicating key OFF envelope waveforms in FIGS. 8 to 12.

When the normal mode is set (SYNM=0), and no mask point is set (MP=0), as shown in FIG. 8:

① When a key OFF event occurs in a state 0 (attack state) before a state to which the decay point DP belongs, and the envelope level is lower than the level of the point DP (level L1), every time the timer interrupt processing is executed, the flow advances from step 538 in FIG. 5B to step 536, and the subroutine ② in FIG. 7 is executed. Therefore, the envelope waveform is caused to decay at the release or sustain rate. When the envelope level EGj becomes equal to or lower than 0 (step 705), the level EGj is set to be 0, and the key OFF flag KOFFj is set. In this manner, in the following timer interrupt processing, since the processing is executed in a path from step 511 to step 525, the envelope level EGj is not increased/decreased, i.e., is kept to be 0. That is, the envelope waveform forming processing is ended.

② When a key OFF event occurs in a state (state 0) before a state to which the decay point DP belongs, and the envelope level is higher than the DP level Li (i=DP), every time the timer interrupt processing is executed, the decay processing at the rate Ri (i=DP) of the DP level is executed in step 539 until the envelope level EGj is decreased to the DP level. Thereafter, the subroutine ② is executed in steps 538 and 536, so that the envelope level is caused to decay at the release or sustain rate.

③ When a key OFF event occurs in a state (state 1) to which the point DP belongs, the envelope level is caused to decay to the DP level at the DP rate, and thereafter, is caused to decay at the release or sustain rate like in the item ②.

④ When a key OFF event occurs in a state (after state 2) after the state to which the point DP belongs, the subroutine ② is executed in step 542, so that the envelope level is caused to decay at the release or sustain rate.

⑤ When the envelope waveform reaches the hold point HP without a key OFF event, the hold state starts from the hold point, as described above. When a key OFF event is detected, the subroutine ② is executed in step 542 every time the timer interrupt processing is executed like in the item ④, so that the envelope level is caused to decay at the release or sustain rate.

When the synthesis mode is set (SYNM=1), and no mask point is set (MP=0), as shown in FIG. 9:

Decay waveforms ① and ② are the same as the decay waveforms ① and ② in the normal mode (FIG. 8). When a key OFF event occurs in a state (state 1) to which the point DP belongs, the decay waveform as the broken line ③ in FIG. 8 is formed. In these cases, the decay waveforms may be caused to decay at the rate R7 of a key OFF EG (to be described later), as shown in FIG. 12.

When a key OFF event occurs in a state (after state 2) after the state to which the point DP belongs like in ④ and ④', the state jumps to a state HP+1 (=4) immediately after the hold point HP (=3) (step 544), and thereafter, every time the timer interrupt processing is executed, the subroutine ① in FIG. 6 is executed in step 514. In this manner, a key OFF envelope waveform (key OFF EG) based on the rates Ri and the target levels Li which are set for states 4 to 7 immediately after the hold point HP is formed. More specifically, the envelope level is increased from the key OFF level to the target level L4 at the rate R4. Thereafter, the envelope level is decreased to the level L5 at the rate R5, and is then increased to the level L6 at the rate R6. Then, the envelope level is caused to decay to the level L7 at the rate R7. This envelope waveform can provide a click feeling to a tone upon a key OFF event. When the state number i becomes 8 (step 614), the key OFF flag KOFFj is set (step 615). Thus, in the following timer interrupt processing operations, the processing is executed in a path from step 511 to step 525, and the envelope level EGj is not increased/decreased. More specifically, the envelope waveform forming processing is ended.

⑤ When the envelope level reaches the hold point HP without a key OFF event, it is held at the hold level, and is caused to decay to form the key OFF EG waveform upon detection of the key OFF event.

When the normal mode is set (SYNM=0), and the mask point MP=1 is set, as shown in FIG. 10:

① When a key OFF event occurs in a state (state 0, e.g., a point ①) before the mask point MP, since the flow branches from step 531 to step 532 until the envelope waveform reaches the mask point MP every time the timer interrupt processing is executed, the envelope level EGj increase/decrease processing (the subroutine ① in FIG. 6) is executed in step 532. However, in this case, a key OFF operation is not started. When the state number i is incremented in step 612, and the envelope waveform reaches the mask point MP, the envelope level is caused to decay to the decay point DP at the rate R1 of the decay point DP (=1). Thereafter, the envelope level is caused to decay at the release or sustain rate.

② When DPINH=1 the envelope waveform is caused to decay at the release or sustain rate regardless of the decay point DP and the key OFF position.

When the synthesis mode is set (SYNM=1), and the mask point MP=1 is set, as shown in FIG. 11:

① When DPINH=1, the flow advances from step 533 or 534 to step 541 regardless of the decay point DP and the key OFF position. Therefore, like in ④ and ⑤ in FIG. 9, a key OFF EG waveform is formed.

② When the envelope waveform reaches the hold point HP (=3) (step 610) without a key OFF event when DPINH=1, the state jumps to a state DP+1 (=2) immediately after the decay point DP (=1) (steps 611 and 523), thus repeating (looping) waveforms in the states 2 and 3. When a key OFF event is detected, a key OFF EG waveform is formed like in ⑤ in FIG. 9.

Modification of the Embodiment

The present invention is not limited to the above embodiment, and various changes and modifications may be made within the spirit and scope of the invention.

For example, in the above-mentioned embodiment, software control is employed. However, control may be made using a special-purpose hardware arrangement.

In the above description, the present invention is applied to an electronic keyboard instrument. The present invention is also applicable to an internal sound source unit of a keyboard.

The mask point, the decay point, and the hold point can be set at arbitrary positions, or may be automatically set in correspondence with a tone color.

The release and sustain states may be switched by, e.g., a foot pedal during a performance.

The envelope waveform is not limited to one constituted by a plurality of line segments unlike in the embodiment, but may be a desired combination of curves. An envelope need not always be formed by designating a level and a rate. For example, a waveform may be stored in a memory.

What is claimed is:

1. An envelope waveform generation apparatus for generating an envelope waveform, comprising:

envelope waveshape forming means for forming, in response to a key-on event, a key-on envelope waveshape which changes with a lapse of time, and for forming, in response to a key-off event, a first key-off envelope waveshape which decays with a lapse of time;

specific position setting means for setting a specific position on the key-on envelope waveshape which corresponds to a lapse of time from the key-on event, the specific position having a corresponding specific envelope level;

detection means for detecting, when a key-off event occurs, whether a corresponding key-off position on the key-on envelope waveshape, at a timing of the key-off event, is before the specific position, and for detecting whether an envelope level of an envelope waveshape formed by the envelope waveshape forming means at said timing is higher than the specific envelope level; and key-off control means for causing the envelope waveshape forming means to generate, on the basis of a detection result of said detection means, a second key-off envelope waveshape in place of the first key-off envelope waveshape until the detected envelope level of the second key-off envelope waveshape reaches the specific envelope level, and for causing the envelope waveshape forming means to generate the first key-off envelope waveshape after the detected envelope of the second key-off envelope waveshape reaches the specific envelope level.

2. An apparatus according to claim 1, wherein the envelope waveform comprises an attack state in which an amplitude is rapidly increased, a decay state in which the amplitude rapidly decays, a hold state in which the amplitude is constant or an identical envelope waveform is repeated, and a release or sustain state in which the amplitude slowly decays, the states being arranged in the order named, each state having an associated rate value.

3. An apparatus according to claim 2, wherein a key-off rate of the second key-off envelope waveshape has the rate value of the release or sustain state of a standard key-off state when the key-off position is after the specific position, and has a large value to more rapidly decay the envelope waveform when the key-off position is before the specific position.

4. An apparatus according to claim 3, wherein the key-off rate of the second key-off envelope waveshape, when the key-off position is before the specific position, is set to be the rate value of the decay state.

5. An envelope waveform generation apparatus for generating an envelope waveform, comprising:

envelope waveshape forming means for forming, in response to a key-on event, a key-on envelope waveshape which changes with a lapse of time and for forming, in response to a key-off event, a key-off envelope waveshape which changes with a lapse of time;

specific position setting means for setting a specific position on the key-on envelope waveshape which corresponds to a lapse of time from the key-on event;

position comparison means for comparing the specific position and a key-off position on the envelope waveform which corresponds to a key-off event; and key-off control means for delaying generation of the key-off envelope waveshape on the basis of a comparison result from said position comparison means.

6. An envelope waveform generation apparatus for generating an envelope waveform, comprising:

envelope waveshape forming means for forming, in response to a key-on event, a key-on envelope waveshape which changes with a lapse of time and forming, in response to a key-off event, a first key-off envelope waveshape which changes with a lapse of time;

specific position setting means for setting a specific position on the key-on envelope waveshape which corresponds to a lapse of time from the key-on event;

detection means for detecting, when a key-off event occurs, whether a key-off position on the key-on envelope waveshape, at a timing of the key-off event, is before the specific position; and control means for designating said envelope waveshape forming means to select one of first and second decay characteristics on the basis of a detection result from said detection means, and decaying the envelope waveform signal in accordance with the designated decay characteristics.

7. An apparatus according to claim 1, wherein the envelope waveform consists of a plurality of states, and the specific position represents an endpoint of one of the plurality of states.

8. An apparatus according to claim 2, wherein a key-off rate of the first key-off envelope waveshape has the rate value of the release or sustain state of a standard key-off state when the key-off position is after the specific position, and has a large value to more rapidly decay the key-off envelope waveshape when the key-off position is before the specific position.

9. An apparatus according to claim 8, wherein the key-off rate, when the key-off position is before the specific position, is set to be the rate value of the decay state.

10. An apparatus according to claim 5, wherein the envelope waveform consists of a plurality of states, and the specific position represents an endpoint of one of the plurality of states.

11. An apparatus according to claim 10, wherein the envelope waveform comprises an attack state in which an amplitude is rapidly increased, a decay state in which the amplitude rapidly decays, a hold state in which the amplitude is constant or an identical envelope waveform is repeated, and a release or sustain state in which the amplitude slowly decays, the states being arranged in the order named, each state having an associated rate value.

12. An apparatus according to claim 11, wherein when the timing of the key-off event occurs before the specific position, the processing of the key-off envelope waveshape is delayed so that a key-off rate of the key-off envelope waveshape is the same as the rate value of a standard key-off state until the key-off position reaches the specific position, at which time the key-off rate has the rate value of the release or sustain state of the standard key-off state.

13. An apparatus according to claim 6, wherein the envelope waveform consists of a plurality of states, and the specific position represents an end point of one of the plurality of states, each state having an associate rate value.

14. An apparatus according to claim 6, wherein when the detected key-off position is before the specific position, the key-off envelope waveshape is caused to decay according to the first decay characteristics, and when the detected key-off position is after the specific position, the key-off envelope waveshape is caused to decay according to the second decay characteristics.

* * * * *